US008561365B2

(12) United States Patent
Albrecht et al.

(10) Patent No.: US 8,561,365 B2
(45) Date of Patent: Oct. 22, 2013

(54) VERSATILE HYBRID WINDOW SYSTEM

(75) Inventors: Scott D. Albrecht, Merrill, WI (US); Mark C. Hoffman, Mosinee, WI (US); James L. Peterson, Medford, WI (US)

(73) Assignee: HWD Acquisition, Inc., Medford, WI (US)

( * ) Notice: Subject to any disclaimer, the term of this patent is extended or adjusted under 35 U.S.C. 154(b) by 543 days.

(21) Appl. No.: 12/431,492

(22) Filed: Apr. 28, 2009

(65) Prior Publication Data

US 2009/0277111 A1 Nov. 12, 2009

Related U.S. Application Data

(60) Provisional application No. 61/052,431, filed on May 12, 2008.

(51) Int. Cl.
*E06B 1/04* (2006.01)

(52) U.S. Cl.
USPC ..... 52/213; 52/204.5; 52/215; 52/656.6

(58) Field of Classification Search
USPC ..... 52/204.1, 204.5, 205, 206, 210, 211, 52/213, 215, 217, 656.4, 656.5, 656.9; 49/504, 246, 248, 250
See application file for complete search history.

(56) References Cited

U.S. PATENT DOCUMENTS 4,240,765 A * 12/1980 Offterdinger ..... 403/402
4,254,583 A 3/1981 Smits et al.
4,328,644 A 5/1982 Scott et al.
4,837,977 A 6/1989 Mauro
5,553,420 A 9/1996 Klimek
6,044,611 A 4/2000 Brunett
6,055,782 A * 5/2000 Morton et al. ..... 52/204.1
6,321,494 B1 11/2001 Oberg
6,745,523 B2 * 6/2004 Petta ..... 52/213
6,992,958 B2 * 1/2006 Kudo et al. ..... 369/47.3
7,073,292 B1 * 7/2006 Minter et al. ..... 49/181
7,150,130 B2 * 12/2006 Kobayashi et al. ..... 52/210
2003/0079414 A1 5/2003 Rangabasyam et al.
2003/0126812 A1 7/2003 Folsom et al.
2004/0118050 A1 6/2004 Liu
2004/0211132 A1 * 10/2004 Petta et al. ..... 52/204.1
2005/0016073 A1 1/2005 Petta et al.
2005/0183351 A1 * 8/2005 Brunnhofer ..... 52/204.5
2007/0011948 A1 1/2007 Rangabasyam et al.
2007/0137119 A1 * 6/2007 Guillemette ..... 52/204.1
2008/0196342 A1 * 8/2008 Franklin ..... 52/309.1

FOREIGN PATENT DOCUMENTS

CA 2 343 865 7/2006

* cited by examiner

*Primary Examiner* — Brian Glessner
*Assistant Examiner* — Adam Barlow
(74) *Attorney, Agent, or Firm* — Merchant & Gould P.C.

(57) ABSTRACT

A window assembly and method of constructing a window assembly is disclosed. The window assembly comprises a base frame assembly, an external cladding assembly, an interior trim assembly and a sash assembly. In one embodiment, the base frame assembly, external cladding assembly and interior trim assembly are constructed from one of three different types of materials. The external cladding assembly may also be snap-fit onto the base frame assembly. Further, the interior trim assembly can include a jamb extension assembly that can also be snap-fit onto the base frame assembly. The interior trim assembly may also include head, sill and side stop assemblies which can be push-fit onto the base frame assembly. Another aspect of the disclosure is a sash assembly that can be assembled as a snap-fit assembly.

16 Claims, 10 Drawing Sheets

VERSATILE HYBRID WINDOW SYSTEM

REFERENCE TO RELATED APPLICATIONS

This application claims priority under 35 USC 119(e) from U.S. Provisional Application 61/052,431, filed on May 12, 2008. The entirety of the disclosure of U.S. Patent Application 61/052,431 is hereby incorporated herein by reference.

TECHNICAL FIELD

This disclosure relates generally to window assemblies, and methods of constructing window assemblies.

BACKGROUND

Window assemblies have historically been fabricated with a structural base frame and a sash frame, in addition to various trim pieces. The base frame is the portion of the window assembly which is attached to the structure of the building. The sash frame is the portion of the window assembly which holds the window pane and fits within the base frame. In some windows, the sash frame is fixed to the frame such that the window cannot be opened. In other embodiments, such as a casement window or a double hung window, the sash frame is movable with respect to the base frame.

Many materials have been utilized to construct window assemblies, such as wood, polyvinyl chloride (PVC), fiberglass and aluminum. Each of these materials has various advantages and disadvantages with respect to the other, such as cost, durability, aesthetics and the ability to prevent air and moisture infiltration. Frequently, the structural and trim pieces of a window assembly are constructed of the same type of material. However, it is sometimes the case that a window assembly will be constructed by using two different materials. For example, interior wood trim pieces have been used in conjunction with a vinyl window assembly to improve the interior aesthetics of the window assembly. Another example is where aluminum or vinyl exterior cladding has been added to a wooden window assembly in order to improve the durability of the window assembly without sacrificing interior aesthetics. In the prior art, including the above cited examples, the components of differing materials in the window assembly are often connected to each other through the use of separate mechanical fasteners and/or sealants. Improvements in window assemblies which utilize more than one material are desired.

SUMMARY

A window assembly is disclosed comprising a base frame assembly, an external cladding assembly, an interior trim assembly and a sash assembly. The base frame assembly, external cladding assembly and interior trim assembly are constructed of a first, second and third material respectively. In one embodiment, the first, second and third materials are each of a different type of material and one of three types of materials, the three types of materials being a wood type material, a metal type material and a non-wood/non-metal type material.

The base frame assembly includes a plurality of base frame members that form a frame, the base frame assembly being attachable to an opening in a wall and being constructed of a first material. The base frame members can be joined with a welded seam.

The external cladding assembly includes a plurality of cladding members that form a frame, the external cladding assembly being connected to the base frame assembly. The external cladding assembly is constructed of a second material. The cladding members can also have cut ends, the cut ends being adjacent to other cut ends of the cladding members to form a frame wherein each cladding member has a crimp at each cut end, the crimp securing the cladding member to a corner key wherein a sealant is present at the location of the corner key and the crimp.

The interior trim assembly conceals at least a portion of the base frame assembly from view from an interior side, the interior trim assembly being constructed of a third material. The interior trim assembly can be comprised of a jamb extender assembly, a head stop assembly, a side stop assembly and a sill stop assembly. The jamb extender assembly can be snap-fit onto the base frame assembly. The sill, side and head stop assemblies can be press-fit onto the base frame assembly.

The sash assembly is constructed and arranged to hold a window pane and is operably connected to the base frame assembly. The sash assembly can have an exterior side constructed of the second material and an interior side constructed of the third material. The sash assembly may have an exterior and interior sash assembly which may be snap fit together. The sash members can also have cut ends, the cut ends being adjacent to other cut ends of the sash members to form a frame wherein each sash member has a crimp at each cut end, the crimp securing the sash member to a corner key wherein a sealant is present at the location of the corner key and the crimp.

A method of constructing a window assembly is also disclosed. The method may include the steps of: forming a base frame assembly defining a frame; forming an exterior cladding assembly defining a frame; snap-fitting the cladding assembly onto the base frame assembly; forming an exterior sash assembly; forming an interior sash assembly; inserting a window pane into the interior sash assembly; forming an assembled sash assembly by snap-fitting the exterior sash assembly onto the interior sash assembly to secure the window pane; and press-fitting an interior trim assembly onto the base frame assembly. The method may also include the step of welding the base frame together. Additionally, the exterior cladding assembly and the exterior sash assembly may be formed by: cutting members of desired length from a stock material such that each cut end of the members is at an angle; inserting corner keys into each of the cut ends of the members; crimping the members onto the corner keys to form frame corners; and injecting sealant into the corners through the corner keys. The method may also include selecting a first material type for the base frame assembly; selecting a second material type for the cladding assembly that is different from the first material type; selecting a material type for the interior trim assembly that is different from the first and second material types; wherein the first, second and third material types are one of a wood type material, a metal type material and a non-wood/non-metal type material.

DETAILED DESCRIPTION OF THE DRAWINGS

Figure 1:
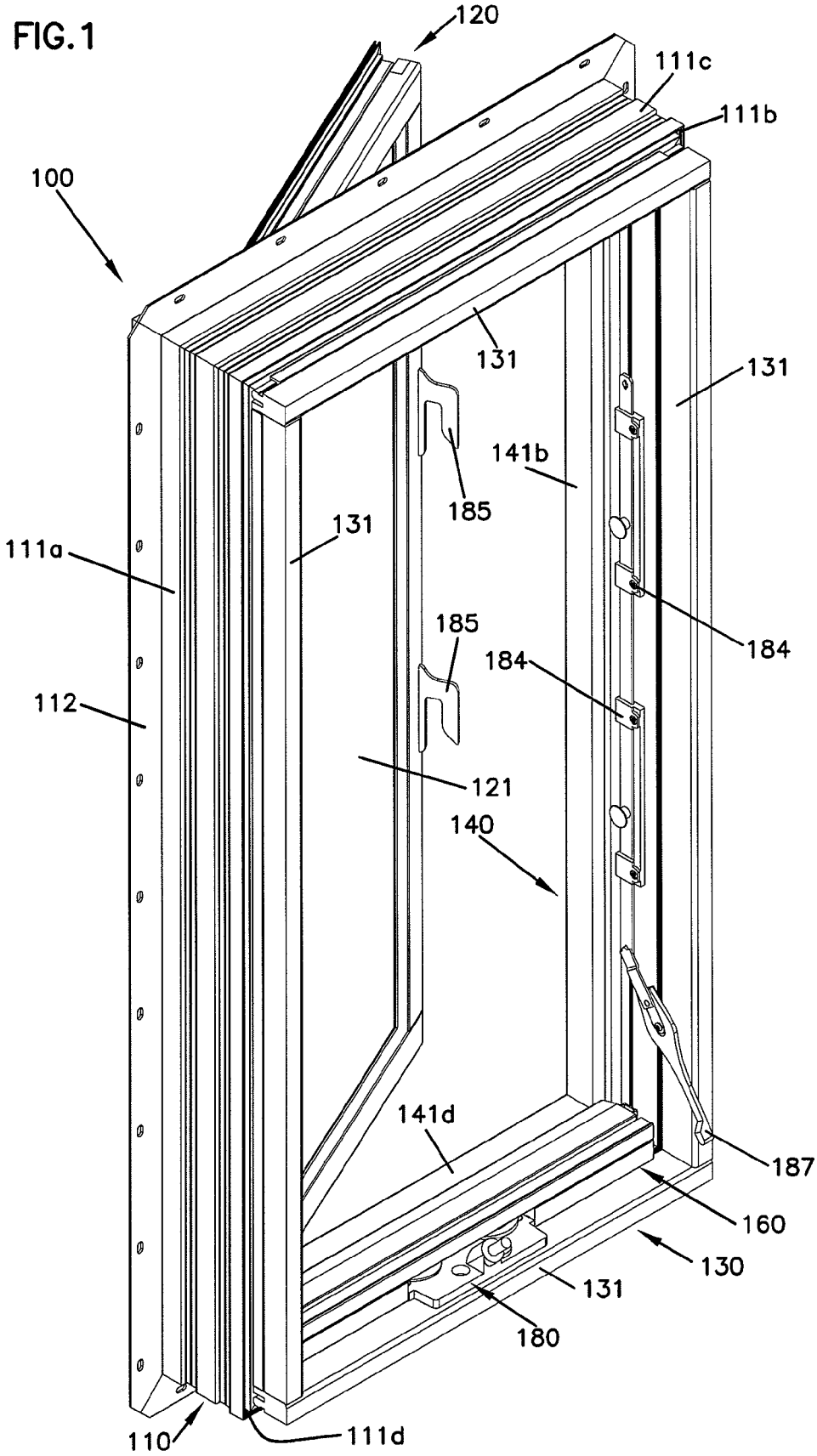
FIG. 1 is a perspective view from the interior side of one embodiment of a window assembly, with the sash frame assembly being in an open position.
Figure 2:
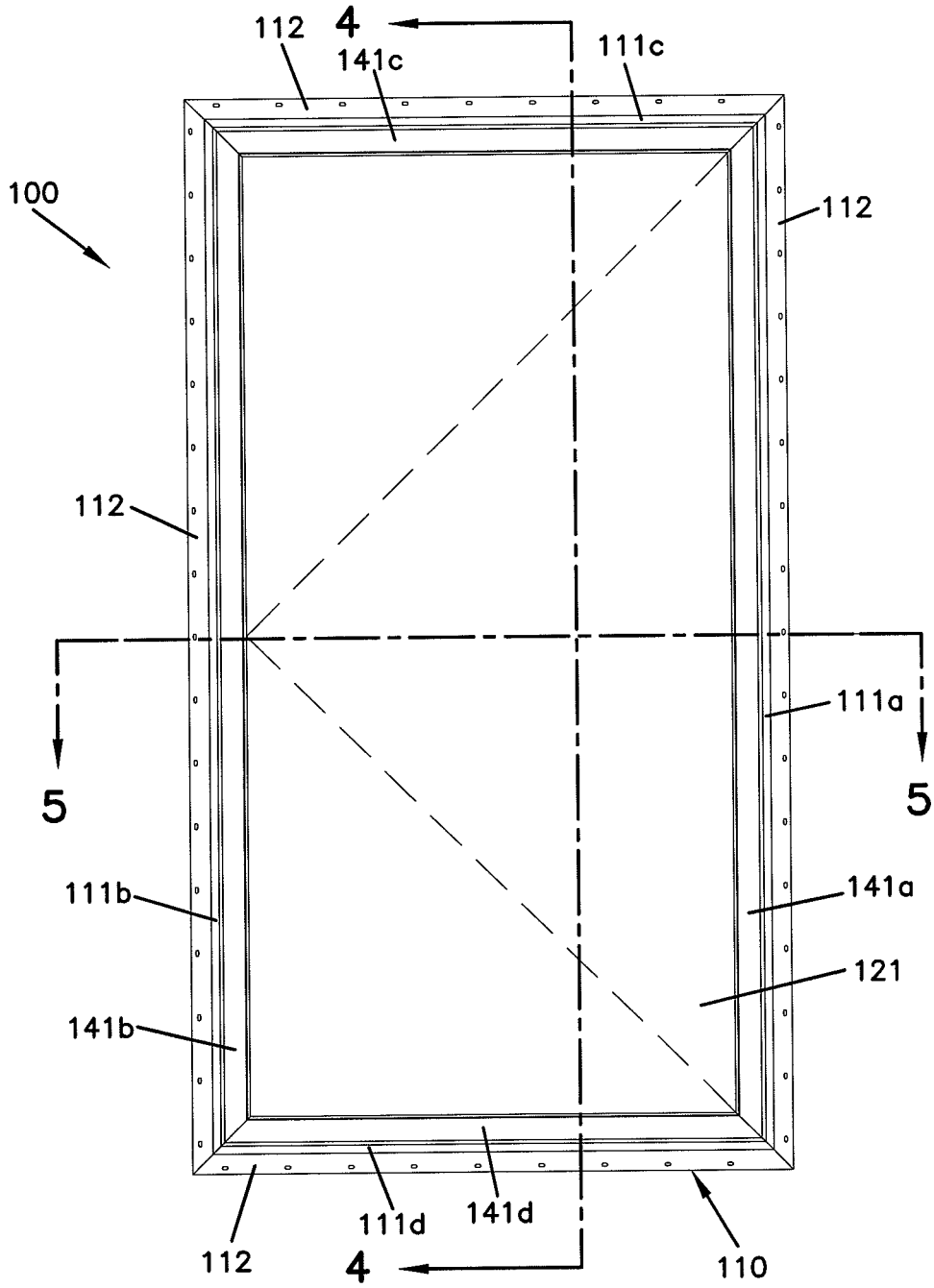
FIG. 2 is a front view of the exterior face of the window assembly of FIG. 1, with the sash frame assembly being in a closed position.
Figure 3:
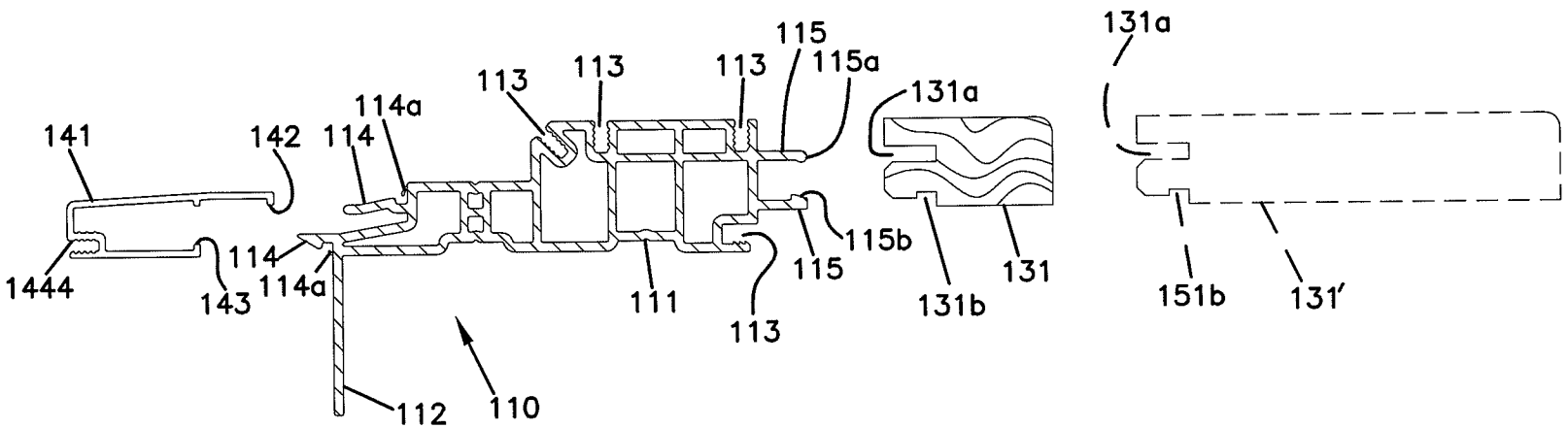
FIG. 3 is a vertical cross-sectional view of a portion of the window assembly of FIG. 1, the cross-section being taken along either of the line 4-4 or 5-5 in FIG. 2.
Figure 4:
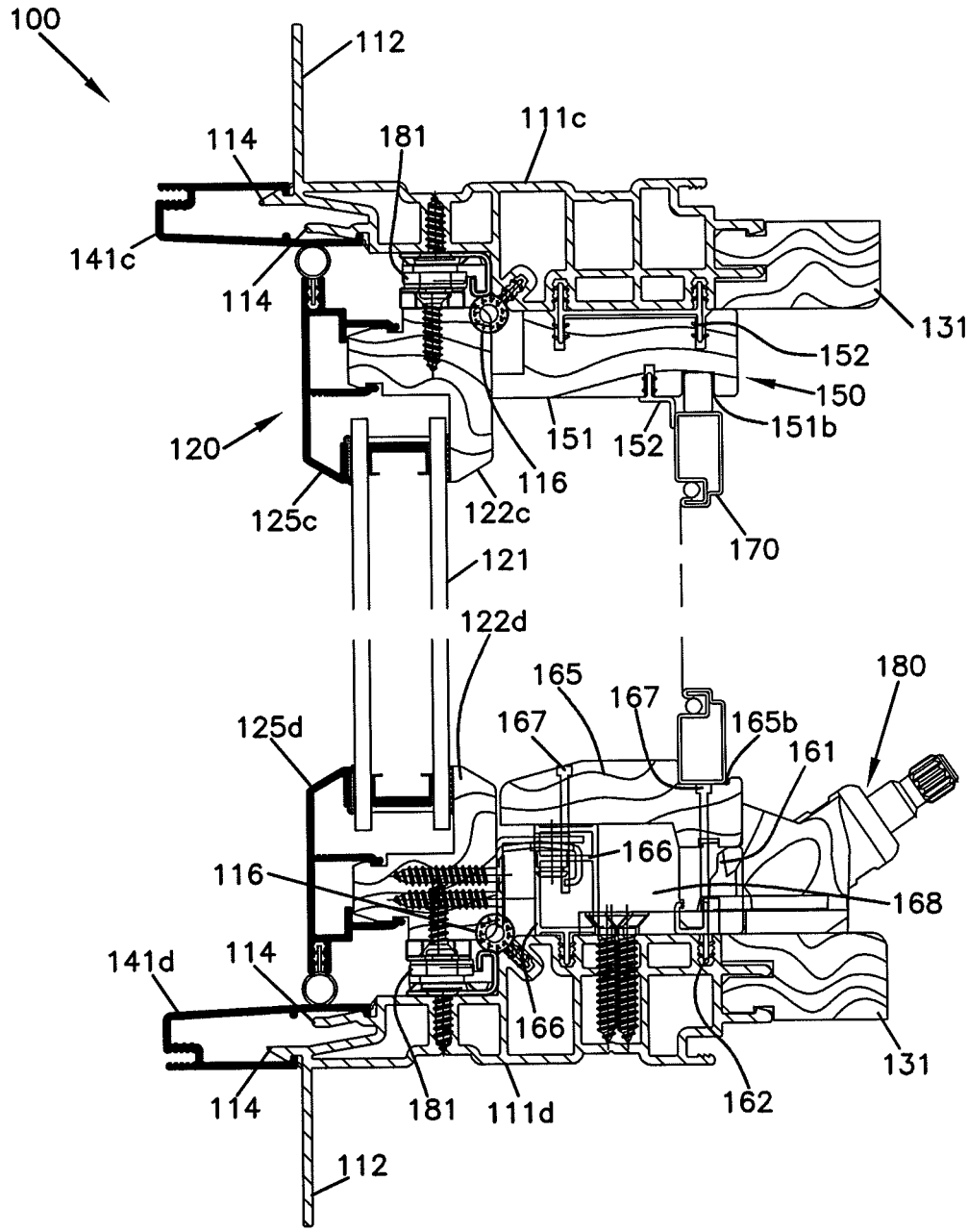
FIG. 4 is a vertical cross-sectional view of the window assembly of FIG. 1, with the sash frame assembly being in a closed position, the cross-section being taken along line 4-4 in FIG. 2.
Figure 5:
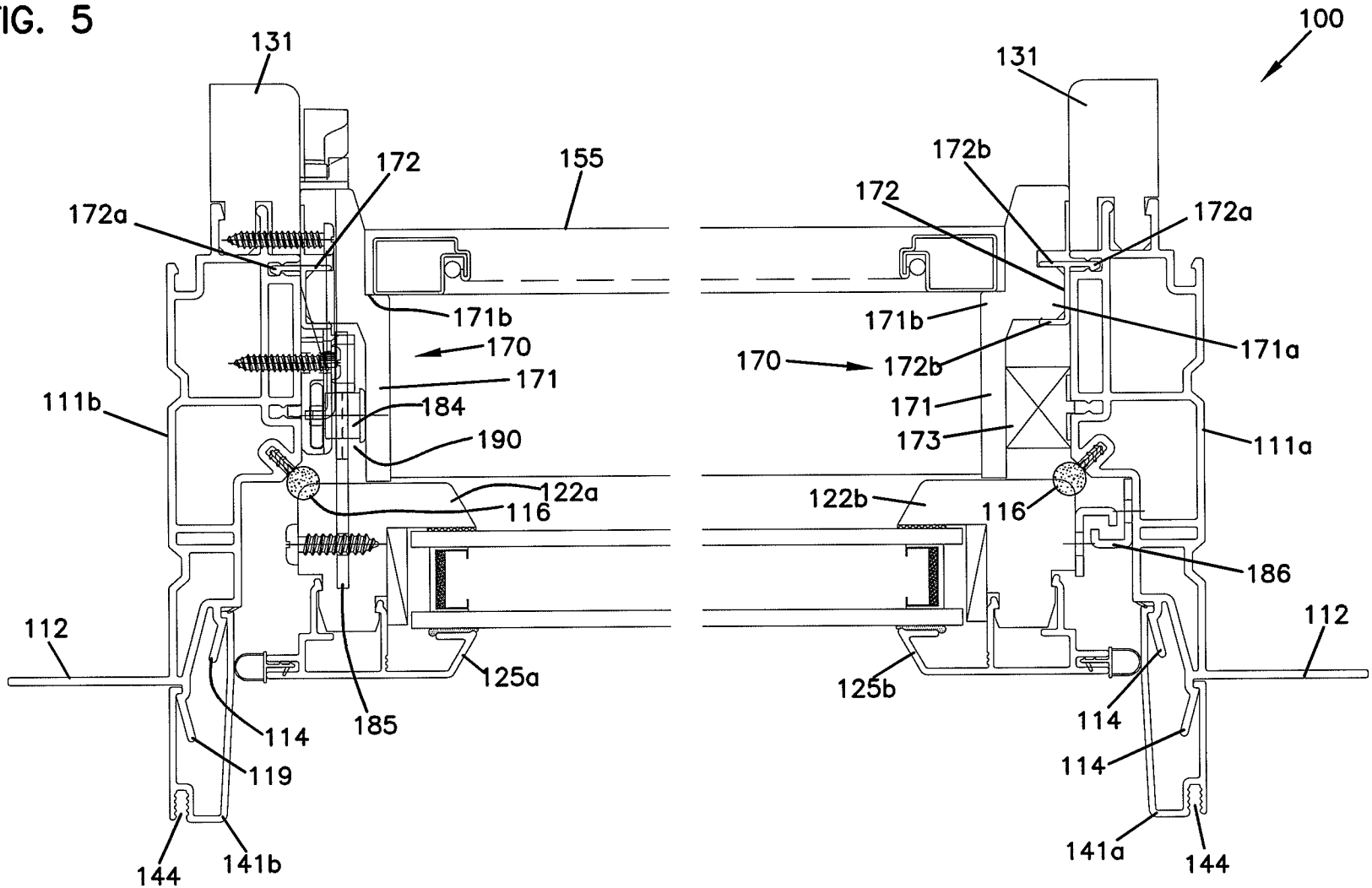
FIG. 5 is a horizontal cross-sectional view of the window assembly of FIG. 1, with the sash frame assembly being in a closed position, the cross-section being taken along line 5-5 in FIG. 2.
Figure 6:
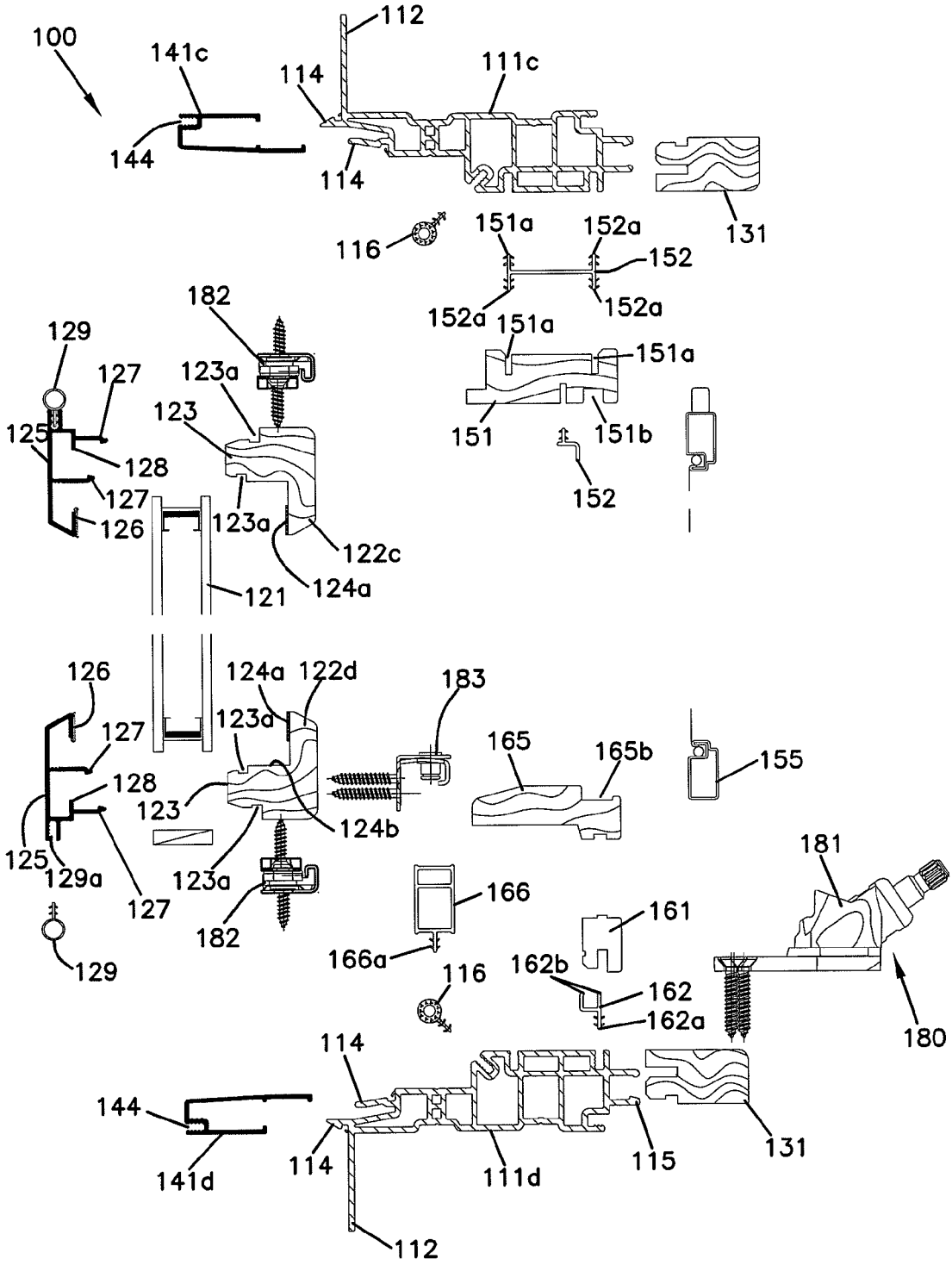
FIG. 6 is a vertical cross-sectional exploded view of the window assembly of FIG. 1.

Reference will now be made in detail to exemplary aspects of the present disclosure that are illustrated in the accompanying drawings. Wherever possible, the same reference numbers will be used throughout the drawings to refer to the same or like parts.

In the embodiment illustrated in FIGS. 1-6, window assembly 100 is shown, as explained in detail below.

One aspect of the disclosure is base frame assembly 110. Base frame assembly 110 is the portion of window assembly 100 that is directly connected to the wall surrounding the opening of a building or other structure. Additionally, base frame assembly 110 is for providing the primary structural support for window assembly 100 and for providing a platform to which the other components of window assembly 100 can be mounted. As shown in FIGS. 1-6, base frame assembly 110 defines a frame having the shape of a rectangle or square from four base frame members, 111*a*, 111*b*, 111*c*, 111*d*. Other shapes are possible. Each of the four base frame members 111*a*, 111*b*, 111*c*, 111*d* is cut from base frame member stock 111. Because each base frame member 111*a*, 111*b*, 111*c*, 111*d* is formed from the same base frame member stock 111, they all have the same cross-sectional profile. Further, base frame member stock 111 can be produced in lineal fashion such that many base frame members can be cut from a single length of stock. Thus, the use of a single lineal profile results in a reduction of frame part types, part machining and assembly time. In the exemplary embodiment shown, base frame member stock 111 is a multi-channeled extrusion of vinyl which has desirable insulating and structural properties. Base frame member stock 111 may be constructed from other extrudeable, pultrudeable or roll formed materials as well, including but not limited to aluminum, steel alloys, polyolefin polymers, cellular PVC (polyvinyl chloride or vinyl) polymers, cellulosic plastic composites, fiberglass composites, polymeric alloys or other extrudeable, pultrudeable and formable material.

To form base frame assembly 110, each base frame member 111*a*, 111*b*, 111*c*, 111*d* is first cut from base member stock 111 to the desired length, with 45 degree corner cuts at each end. Subsequently, the members are joined together to form base frame assembly 110. Where base frame member stock 111 is constructed from vinyl, or any other weldable material, base frame members 111*a*, 111*b*, 111*c* and 111*d* may be joined together by welding to form a welded seam and a water and air tight assembly. Once assembled, base members 111*a* and 111*b* form the side jambs for window assembly 100 while 111*c* and 111*d* form the head and sill jambs, respectively. Also, base frame member stock 111 can be formed with weather seal 116 such that the seal is automatically present when the base frame members are formed. Seal 116 can either be integral or inserted into a kerf 113 as base frame member stock 111 is formed, or shortly thereafter. Further weather seal 116 can be weldable, such that the seal is made contiguous once the frame is assembled and welded together.

As mentioned previously, the base frame members all have the same cross-sectional area because they are all cut from base frame member stock 111. For ease of reference, the section shown in FIG. 3 will be referred to as base frame member 111, although it should be appreciated that all of the identified features of FIG. 3 apply equally to each of base frame members 111*a*, 111*b*, 111*c* and 111*d*. In the exemplary embodiment shown, base frame member 111 includes a nail fin 112, a plurality of multipurpose kerfs 113, cladding clips 114 and jamb extender clips 115. Each of these features is described in the following paragraphs.

Nail fin 112 is for providing structural support and serves as a means for attaching window assembly 100 into a building window rough opening. As shown, nail fin 112 is integral to base frame member 111, however, nail fin 112 could be a separate component that is attached to base frame member 111 through the use of a multi-purpose kerf 113, discussed below, or other attachment device. However, the structural and weather tightness of an integral nail fin are not generally accomplished with the use of a separate nail fin.

Multipurpose kerfs 113 are recesses within base member 111 and are used for the attachment of a variety of window assembly components having corresponding extensions for insertion into the kerfs 113. Examples of components that may be inserted into kerfs 113 are weather stripping, attachment clips and support blocks. These and other components are discussed in more detail later in the specification. Once the extensions are inserted into any of the multipurpose kerfs 113, the component is securely attached to base frame member 111. To improve the degree to which the component is secured, kerfs 113 may be constructed to have inward protrusions to further engage the extensions of the components. Alternatively, the extensions may be barbed. Inserts can also be used within the kerfs. As shown in the figures, both inward kerf protrusions and barbed component extensions are used to ensure a secure connection. It should also be noted that the component extensions generally run the entire length of the kerf 113 to which it is attached. However, where practical, the component extensions could be constructed to engage the kerfs 113 at selected intervals.

Cladding clips 114 are for engaging cladding components which are discussed in further detail later in the specification. In the embodiment shown, cladding clips 114 are integral to base frame member 111, but could be formed as a separate attachment through the use of kerfs, adhesives or mechanical fasteners. As shown, cladding clips 114 extend from base frame member 111 and have recesses 114*a* for engaging a corresponding inward projections from the cladding component. However, it should be noted that cladding clips 114 could have the outward projections and the cladding component could be constructed to have recesses to achieve essentially the same result. This construction provides for a secure, snap-fit assembly between base frame member 111 and the cladding component which results in an advantageous weather tight seal between the cladding components and base frame member 111. By "snap-fit" it is meant that a connection of the components can be achieved by simply pressing the components together until a clip snaps into a corresponding recess. In contrast, many types of prior art window assemblies have exterior cladding components which must be attached to a base frame through the use of mechanical fasteners or adhesives wherein a sealant must be used to make the connection water tight in order to prevent moisture infiltration. Not only is this a labor intensive process, but the sealant and adhesives must also be allowed to cure which further increases production time. Additionally, moisture infiltration can compromise the structural integrity of the window assembly, especially when the window assembly experiences multiple freeze-thaw cycles. Also, where the base frame is wood, moisture infiltration beneath exterior cladding can result in wood rot. The disclosed use of a base frame member 111 having cladding clips 114 in conjunction with cladding members having corresponding inward projections avoids all of the aforementioned disadvantages of the prior art.

Jamb extender clips 115 are for engaging a jamb extender assembly 130 comprised of four jamb extenders 131 or 131'. Jamb extenders 131 are for extending the effective width of each side of the window assembly 100 such that it will match the width of the rough opening into which it is placed. As the position of window assembly 100 in the rough opening is determined by nail fin 112, a jamb extender, 131 or 131' is required to bring the interior side of window assembly 100 flush with the interior wall. As shown, jamb extender 131 is for making a 4 and 9/16 inch wide jamb while jamb extender 131' is for making a 6 and 9/16 inch wide jamb. In the embodiment shown, jamb extender clips 115 are integral to base frame member 111, but could be formed as a separate attachment through the use of kerfs, adhesives or mechanical fasteners. As shown, jamb extender clips 115 extend from base frame member 111 and have inwardly extending protrusions 115*a* and 115*b* for engaging corresponding recesses 131*a* and 131*b* of a jamb extender 131 or 131'. To connect the jamb extender 131 or 131' to base frame member 111, all that is required is to press jamb extender 131, 131' such that recesses 131*a* and 131*b* are aligned with clips 115. In the particular embodiment shown, as jamb extender 131 or 131' is fully pressed towards base frame member 111, protrusion 115*b* snaps into recess 131*b* while protrusion 115*a* forces the other clip to an expanded position, thereby creating a compressive force against jamb extender 131 or 131'. Such a construction ensures a secure connection between base frame member 111 and jamb extender 131 or 131' without the need for adhesives or mechanical fasters, as is the case with many prior art designs. Thus, the disclosed configuration further reduces manufacturing costs of window assembly 100. It should also be appreciated that a different combination of protrusions and recesses may be used without departing from the concepts disclosed herein.

Another aspect of the disclosure is exterior cladding assembly 140 which is for providing a durable and aesthetically pleasing exterior surface for window assembly 100. As shown in FIGS. 1-6, exterior cladding assembly 140 defines a frame in the shape of a rectangle or square from four exterior cladding members, 141*a*, 141*b*, 141*c*, 141*d*. Other shapes are possible. Each of the exterior cladding members 141*a*, 141*b*, 141*c*, 141*d* is cut from exterior cladding stock 141. Because each exterior cladding member 141*a*, 141*b*, 141*c*, 141*d* is formed from the same exterior cladding stock 141, they all have the same cross-sectional profile. Further, exterior cladding stock 141 can be produced in lineal fashion such that many exterior cladding members can be cut from a single length of stock. Thus, the use of a single lineal profile results in a reduction of frame part types, part machining and assembly time. In the exemplary embodiment shown, exterior cladding stock 141 is a painted aluminum extrusion. Exterior cladding stock 141 may be constructed from other extrudeable, pultrudeable or roll formed materials as well, including but not limited to steel alloys, polyolefin polymers, cellular PVC (polyvinyl chloride or vinyl) polymers, cellulosic plastic composites, fiberglass composites, polymeric alloys or other extrudeable, pultrudeable and formable material.

To form exterior cladding assembly 140, each exterior cladding member 141*a*, 141*b*, 141*c*, 141*d* is first cut from exterior cladding stock 141 to the desired length, with 45 degree corner cuts at each end. Other angles can be used as well where non-rectangular window shapes are desired. Subsequently, the members are joined together to form exterior cladding assembly 140. Where exterior cladding stock 141 is constructed from vinyl, or any other weldable material, exterior cladding members 141*a*, 141*b*, 141*c*, 141*d* may be joined together by welding to form a water and air tight assembly.

Figure 9A:
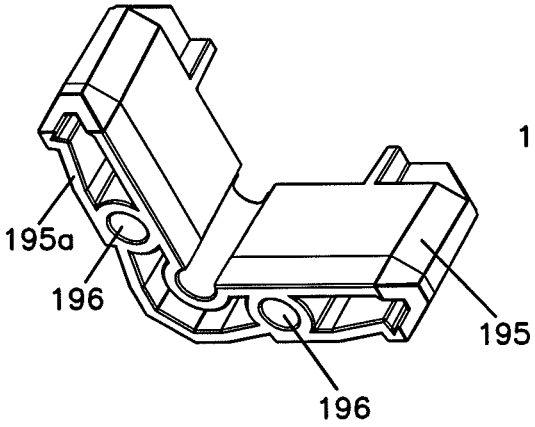
FIG. 9A is a perspective view from the injection side of an embodiment of a corner key.
Figure 9B:
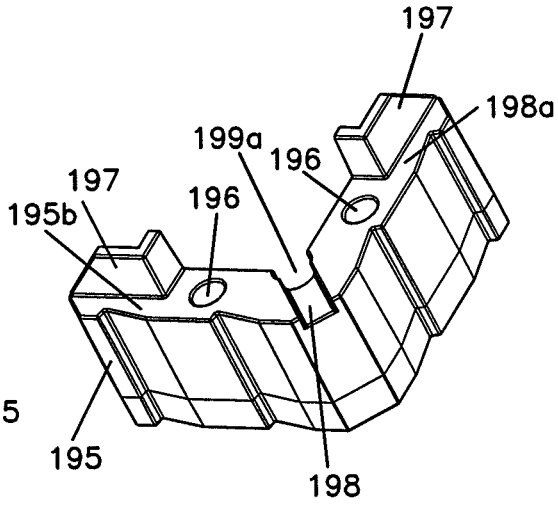
FIG. 9B is a perspective view from the cavity side of the corner key of FIG. 9A.
Figure 9C:
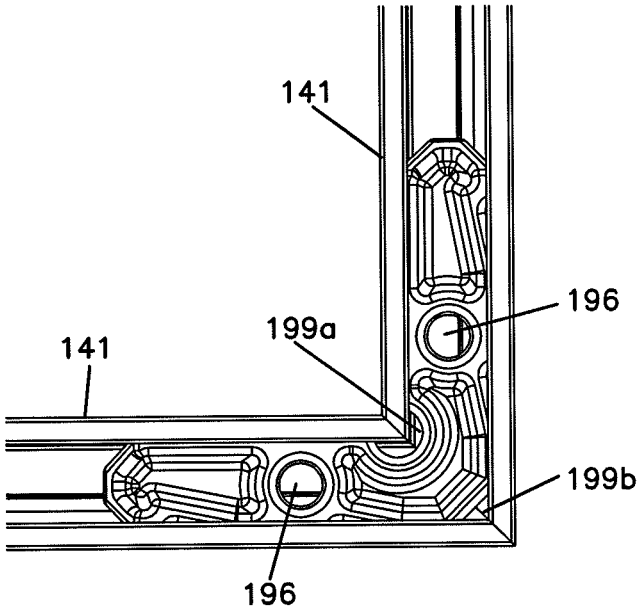
FIG. 9C is a plan view of an exterior cladding assembly corner of the window assembly of FIG. 1, with the corner key of FIG. 9A installed.

Alternatively, exterior cladding assembly 140 may be assembled through the use of corner keys 195 that are inserted at each corner of the frame. Corner keys 195 are for securing members 141*a*, 141*b*, 141*c*, 141*d* together and for creating a weather tight seal at the corners of the frame. In the embodiment shown in FIGS. 9A-9C, each corner key 195 has holes 196, upright legs 197 and recesses 198 and 199. To assemble a corner of the frame, corner key 195 is inserted into the ends of two members 141*a*, 141*b*, 141*c*, 141*d*. Once inserted, the member ends may be crimped onto corner key 195 to further secure the corner beyond a simple frictional fit. To create a seal at each corner, sealant is injected into holes 196 from an injection side 195*a* of corner key 195. As sealant is injected into holes 196, the sealant progresses to the cavity side 195*b* of corner key 195 and into a void space defined by cavity side 195*b*, upright legs 197 and the adjacent surfaces of the members connected to the corner key. The sealant also flows into recesses 198 and into void spaces 199*a* and 199*b* which together ensure that sealant is present directly over the joint between the members. Once the sealant cures, the sealant and corner keys 195 seal the entire miter joint of the two abutting member ends to form a weather tight seal at each corner.

In the embodiment shown, exterior cladding stock 141 has inward projections 142 and 143 that are designed to engage recesses 114*a* of cladding clips 114. Exterior cladding stock 141 also has a kerf 144 for the mounting of additional accessories, where desired. The construction of exterior cladding stock 141 allows for exterior cladding members 141*a*, 141*b*, 141*c*, 141*d*, once assembled to form exterior cladding assembly 140, to snap-fit onto cladding clips 114. As exterior cladding members 141*a*, 141*b*, 141*c*, 141*d* are depressed onto cladding clips 114, the cladding clips 114 expand the exterior cladding members 141*a*, 141*b*, 141*c*, 141*d* until the inward projections 142 and 143 snap into recesses 114*a*. Even after snapping into recesses 114*a*, cladding members 141*a*, 141*b*, 141*c*, 141*d* remain slightly expanded such that a weather tight and secure connection is achieved. Because of this construction, exterior cladding assembly 140 can be installed onto base frame assembly 110 without the use of tools, adhesives, sealants or mechanical fasteners, thereby decreasing capital expenditures and manufacturing costs.

Yet another aspect of the disclosure is the use of head stop, sill stop and side stop assemblies, 150, 160, 170 which can be collectively referred to as an interior trim assembly. Jamb extender assembly 130 can also be considered part of the interior trim assembly. Each of these assemblies is for providing an aesthetically pleasing surface to the interior surfaces of window assembly 100, and to conceal certain mechanical components of operator mechanism 180. Additionally, head stop, sill stop and side stop assemblies, 150, 160, 170 collectively provide a stop for a sash assembly 120, discussed later, to close against in a casement window application. However, it should be understood that the number and type of interior trim assembly components used can be varied without departing from the concepts presented herein. Head stop, sill stop and side stop assemblies, 150, 160, 170 are discussed in the following paragraphs.

Head stop 150 assembly is for providing an aesthetic surface at the upper interior side of window assembly 100, in addition to providing for a stop for sash assembly 120. As shown, head stop assembly 150 includes head stop 151 which is connected to base frame member 111*c* through the use of an attachment clip 152. Attachment clip 152 has extensions 152*a* which are for inserting into kerfs 151*a* in head stop 151 and kerfs 113 in base frame member 111*c*. In the particular embodiment shown, extensions 152*a* are barbed. Head stop 151 also includes a kerf 151*b*, which in combination with clip 152, operates to secure a window screen 155, where used. This construction allows for head stop assembly 150 to be push-fit onto frame member 111*c* without the use of tools, adhesives or additional fasteners. By "push-fit" it is meant that a frictional connection between components is achieved simply by pushing or pressing the components together such that an extension extends into a recess, such as a kerf. Additionally, head stop assembly 150 can be removed and reinstalled without the use of tools in the event that painting or finishing after window installation is desired, or where service of the window assembly is necessary. Further, as no nails or other fasteners must be used, it is not necessary to wait for filler in the resulting recesses to cure before finishing the product. Typical prior art window assemblies which use nails or other fasteners do not have these advantages.

Sill stop assembly 160 is for providing an aesthetic surface at the front and lower interior sides of window assembly 100, in addition for providing a stop for sash assembly 120. In the embodiment shown, sill stop assembly 160 includes sill block 161 and sill stop 165. As shown, sill block 161 attaches to base frame member 111*d* through the use of attachment clip 162. Attachment clip 162 has an extension 162*a* which inserts into a kerf 113 of frame member 111*d*. In the embodiment shown, extension 162*a* is barbed. At the other end of attachment clip 162 are clips 162*b* which positively engage sill block 161 in the same manner that jamb extension clips 115 engage jamb extenders 131. As shown, sill stop 165 rests on sill block 161 and attachment clip 166. Additionally, sill stop 165 is connected to sill block 151 and clip 166 via fasteners 167 to form an assembly. As shown, fasteners 167 are nails. Attachment clip 166 has an extension 166*a* which inserts into a kerf 113 of frame member 111*d*. In the embodiment shown, extension 166*a* is barbed. Sill stop 165 also includes a recess 165*b* for receiving and retaining screen 155. As can be best viewed in FIG. 4, sill block 161, sill stop 165 and base frame member 111*d* combine to form a cavity space 168 above frame member 111*d*. Cavity space 168 allows for the concealed installation and operation of the components of operator mechanism 180, discussed later. Further, once sill block 161, sill stop 165 and attachment clips 162, 166 have been assembled with fasteners 167 to form sill stop assembly 160, the assembly can be installed, removed and reinstalled in a push-fit manner without the use of tools or the need for additional fasteners or adhesives in a similar manner to head stop assembly 150.

Side stop assembly 170 is for providing an aesthetic surface at the vertical interior sides of window assembly 100, in addition to providing for a stop for sash assembly 120. As shown side stop assembly 170 includes a side stop 171 that is connected to base frame member 111*a* or 111*b* through the use of an attachment clip 172. Attachment clip 172 has an extension 172*a* which is for inserting into a kerf 113 in base frame member 111*a* or 111*b*. In the particular embodiment shown, extensions 172*a* are barbed. Attachment clip 172 also has extensions 172*b* which engage a tongue 171*a* of side stop 171. This construction allows for side stop 171 to be push-fit onto and easily pulled off of frame member 111*a* or *b* without the use of tools, adhesives or additional fasteners. It should also be noted that, in the application of a casement window, side stop 171 will conceal sash lock tie bar mechanism 184 such that only lock operator 187, used to lock and unlock the mechanism, is exposed. Additionally, on the side opposite of sash lock tie bar mechanism 184, a side stop support block 173 may be used to further support side stop 171. Lastly, side stop 171 is shown as including shoulders 171*b* for supporting screen 155, where installed.

Another aspect of window assembly 100 is sash assembly 120. Sash assembly 120 is for securing a window pane 121 and for providing a moveable assembly such that the window assembly 100 can be opened to the outdoors, where desired. In the exemplary embodiment shown, sash assembly 120 includes an interior sash assembly 122 which snap-fits onto an exterior sash assembly 125 thereby securing window pane 121. Interior and exterior sash assemblies 122, 125 may be made from the same or different materials.

Interior sash assembly 122 is for supporting the interior side of the window pane 121 and is also that portion of sash assembly 120 that is viewable from the interior. As such, interior sash assembly 122 is preferably constructed from an aesthetically pleasing material. In the embodiment shown, interior sash assembly 122 is constructed of wood. To form interior sash assembly 122, four segments, 122*a*, 122*b*, 122*c*, 122*d* are first machined to the desired length and such that each segment end has either a mortise or a tenon. The four segments 122*a*, 122*b*, 122*c*, 122*d* are then joined to form a frame, such as square or rectangle by various means known in the art. However, it should be noted that interior sash assembly 122 can be adapted to conform to other window shapes.

Exterior sash assembly 125 is for supporting the exterior side of the window pane 121 and is also that portion of sash assembly 120 that is exposed to the exterior weather. As such, exterior sash assembly 125 is preferably constructed from a material that is weather proof and durable, in addition to being aesthetically pleasing. In the embodiment shown, exterior sash assembly 125 is constructed of painted aluminum. To form exterior sash assembly 125, four segments, 125*a*, 125*b*, 125*c*, 125*d* are first cut from lineal stock material with about 45 degree corner cuts. The four segments 125*a*, 125*b*, 125*c*, 125*d* are then joined to form a frame, such as a square or rectangle, such as by cutting the ends of the segments at angles other than 45 degrees. However, it should be noted that exterior sash assembly 125 can be adapted to conform to other window shapes. Because exterior sash assembly segments 125*a*, 125*b*, 125*c*, 125*d* can be formed from lineal stock rather than custom fabricated segments, production costs and time are reduced.

Figure 10A:
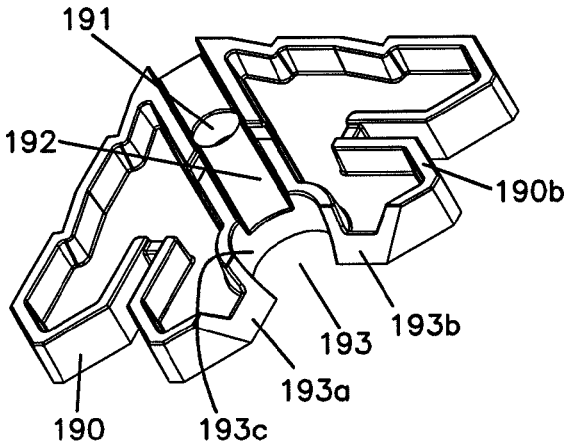
FIG. 10A is a perspective view from the cavity side of a second embodiment of a corner key.
Figure 10B:
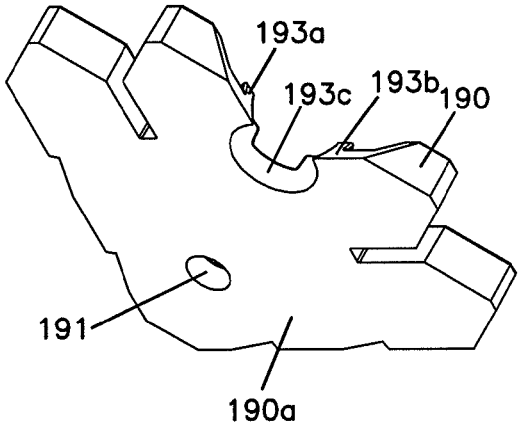
FIG. 10B is a perspective view from the injection side of the corner key of FIG. 10A.
Figure 10C:
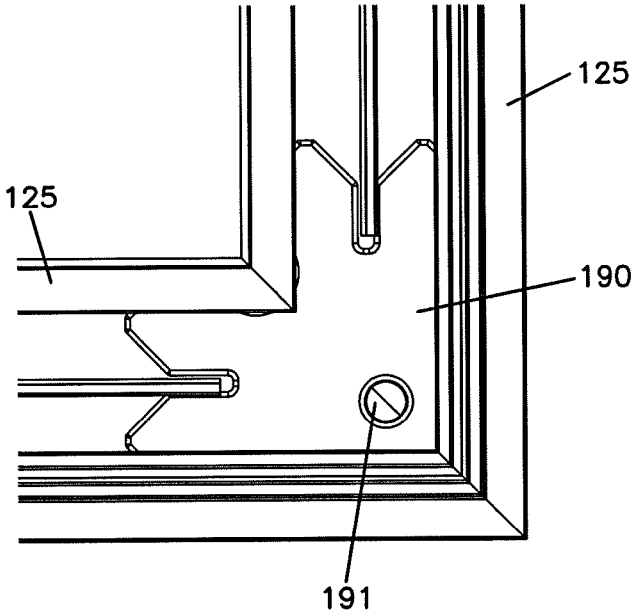
FIG. 10C is a plan view of an exterior sash assembly corner of the window assembly of FIG. 1, with the corner key of FIG. 10A installed.

One way of joining segments 125*a*, 125*b*, 125*c*, 125*d* to form a frame is through the use of corner keys 190 that are inserted at each corner of the frame. Corner keys 190 are for securing the segments together and for creating a weather tight seal at the corners of the frame. In the embodiment shown in FIGS. 10A-10C, each corner key 190 has a hole 191 and recesses 192 and 193. To assemble a corner of the frame, corner key 190 is inserted into the ends of two segments 125*a*, 125*b*, 125*c*, 125*d*. Once inserted, the segment ends may be crimped onto corner key 190 to further secure the corner beyond a simple frictional fit. To create a seal at each corner, sealant is injected into hole 191 from an injection side 190*a* of corner key 190. As sealant is injected into hole 191, the sealant progresses to the cavity side 190*b* of corner key 190, into recess 192 and then into recess 193. Recess 193 is defined by walls 193*a*, 193*b* and 193*c* of corner key 190. Sealant also flows beyond recesses 192 and 193 into the void spaces defined by the corner key 190 and the adjacent surfaces of the connected segments until sealant completely covers the joint formed by the segments. Once the sealant cures, the sealant and corner keys 190 seal the entire miter joint of the two abutting segment ends to form a weather tight seal at each corner.

To assemble sash assembly 120, window pane 121 is first set into interior sash assembly 122 such that a face portion 124*a* of interior sash assembly 122 is adjacent to window pane 121. Subsequently, exterior sash assembly 125 is pressed onto the interior sash assembly 122 such that a face portion 126 of exterior sash assembly 125 is adjacent to the exterior side of window pane 121. Once assembled, a shoulder portion 124*b* supports the weight of window pane 121 while face portions 124*a* and 126 secure the window in a lateral direction.

Sash assembly 120 can be snap-fit together through the use of clips and recesses. In the embodiment shown, exterior sash assembly 125 has attachment clips 127 with inward protrusions that are designed to snap-fit into recesses 123*a* of a tongue 123 of interior sash assembly 122. As exterior sash assembly 125 is pressed onto interior sash assembly 122, attachment clips 127 are expanded by tongue 123 until the inward protrusions of attachment clip 127 snap into recesses 123*a*. Even after snapping into recesses 123*a*, attachment clips 127 are still slightly expanded in order to ensure a weather proof fit between interior and exterior sash assemblies 122, 125. Additionally, stops 128 are provided to ensure that exterior sash assembly 125 is not over compressed onto interior sash assembly 122. Also, gasketing or sealant can be provided on face portions 126 and 124*a* to improve the seal against window pane 121. Exterior sash assembly 125 also includes seals 129 which are inserted into kerfs 129*a*. Seals 129 primarily operate to seal off dust and are located between sash assembly 120 and exterior cladding assembly 140 when window assembly 100 is in a closed position. Weather stripping 116 is also provided in a kerf 113 of the base frame assembly 110. Weather stripping 116 is provided to ensure a weather tight seal that minimizes air and water infiltration between sash assembly 120 and base frame assembly 110. Once assembled, sash assembly 120 is operably or pivotally attached to base frame assembly 110 of window assembly 100 via hinges 182 and operator arm track 183, discussed later.

Yet another aspect of the disclosure is window operator mechanism 180. Window operator mechanism 180 is for allowing a user to open and close window assembly 100 by rotating an operator arm (not shown). Window operator mechanism 180 is also for locking window assembly 100 in a locked position. In the embodiment shown, operator mechanism 180 includes operator 181, hinges 182, operator arm track 183, sash lock tie bar mechanism 184, sash lock keeper 185, sash snubber 186 and lock operator 187. As shown, each of the aforementioned components is attached through the use of screws. Together, these components allow a user to open and close window assembly 100 through the manipulation of operator 181. Further, by manipulating lock operator 187, the window assembly can be placed in a locked position whereby sash lock tie bar mechanism 184 engages sash lock keepers 185.

Figure 7:
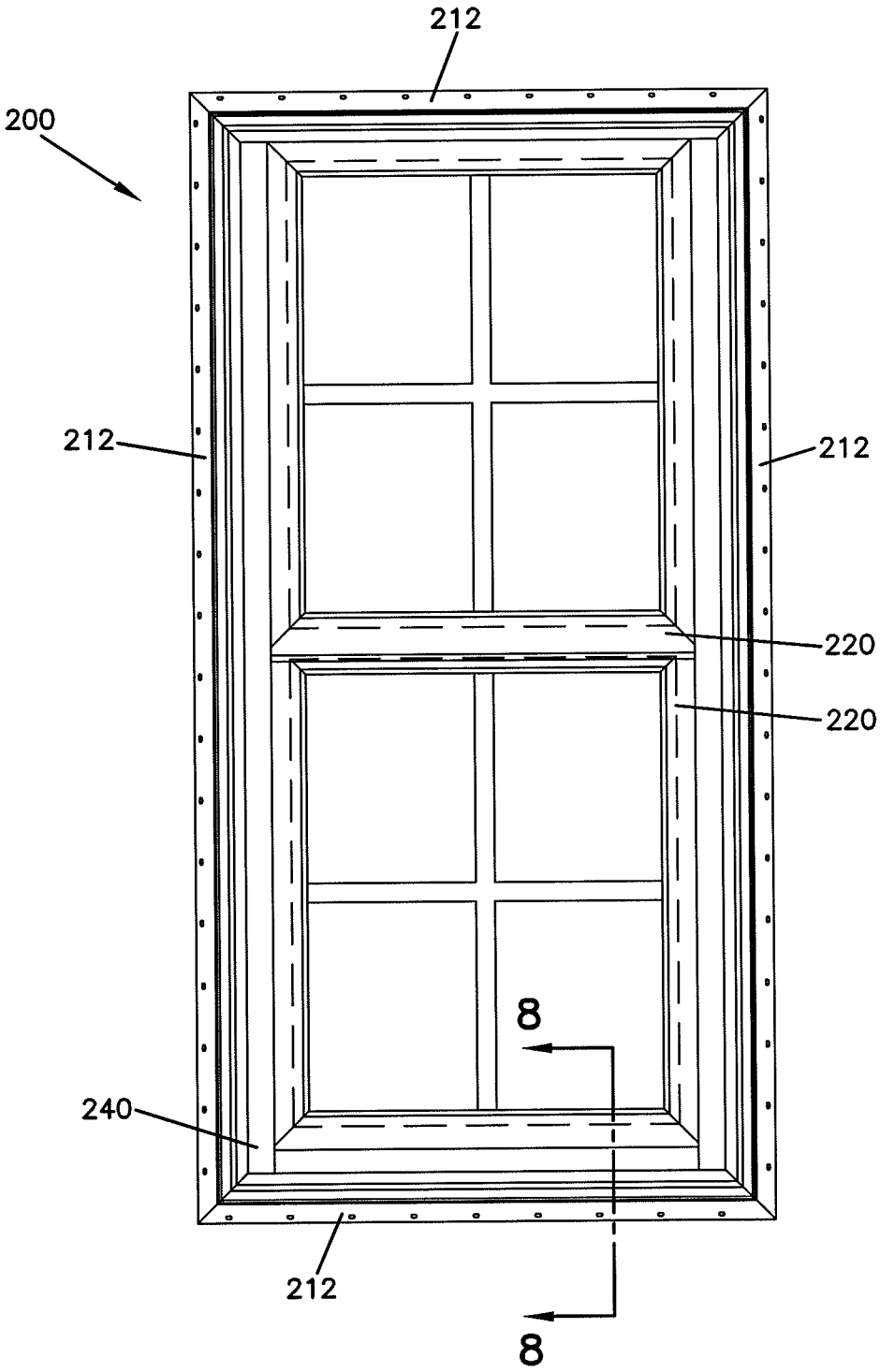
FIG. 7 is a front view of the exterior face of a double hung embodiment of a window assembly, with the sash frame assembly being in a closed position.
Figure 8:
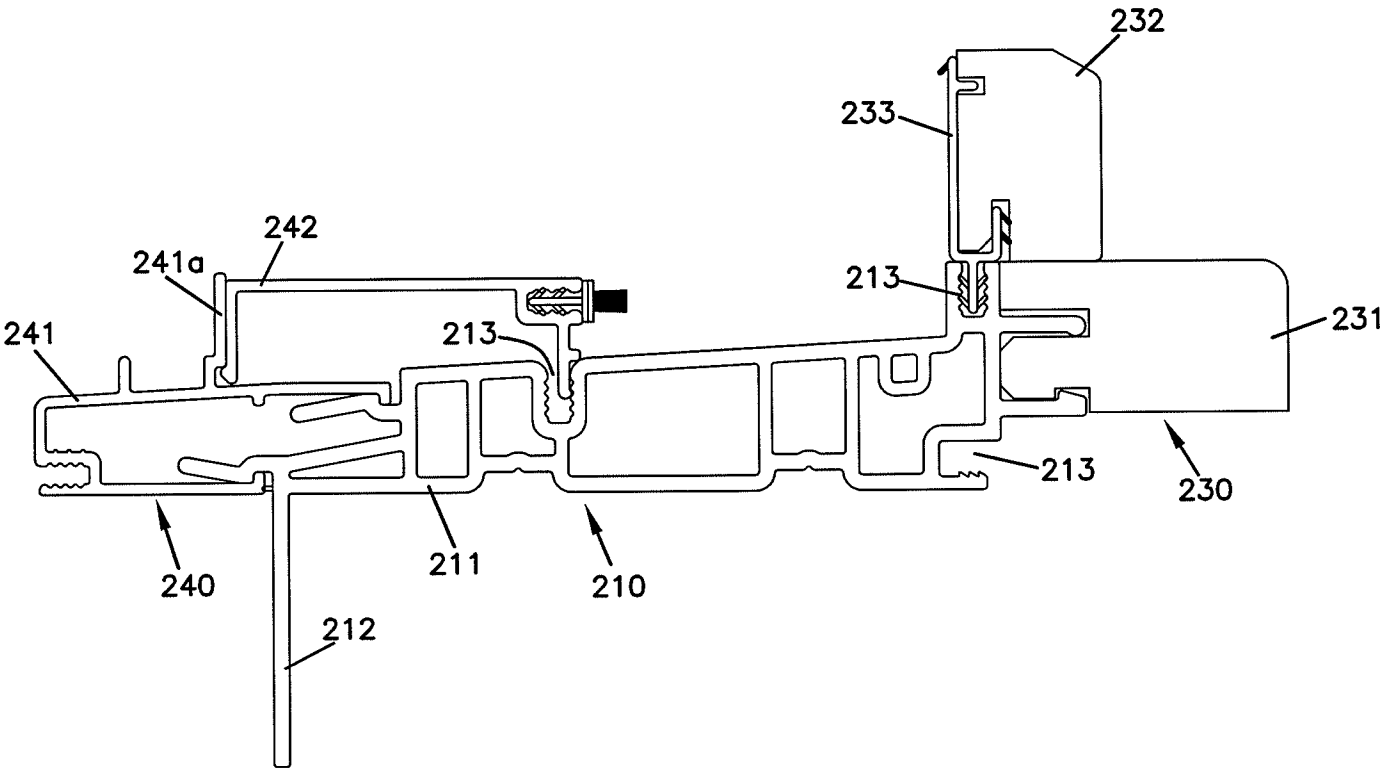
FIG. 8 is a side cross-sectional view of the bottom portion of the window assembly of FIG. 7, the cross-section being taken along line 8-8 in FIG. 2.

The base frame concept presented herein can be used with window types other than casement windows, such as awning, single hung, double hung and sliding windows. With reference to FIGS. 7-8, a second embodiment of the disclosure is provided in the form of a double hung window assembly 200. Window assembly 200 includes many of the same components as window assembly 100 and the entirety of the description of window assembly 100 is hereby incorporated. For example, window assembly 200 includes base frame assembly 210, sash assembly 220, jamb extenders 230 and exterior cladding assembly 240. As shown, base frame assembly 210 includes base frame member 211, nail fin 212 and kerfs 213. Exterior cladding assembly 240 includes a frame having two exterior members, 241 and 242 on each side wherein the members are adapted for use in a double hung window application. Member 241 is similar to cladding member 141, but with the addition of a vertical flashing portion 241*a*. Additionally, member 242 is located between vertical flashing portion 241*a* and a kerf 213 and forms a horizontal weather proof exterior surface suitable in a double hung window application. Another difference between window assembly 100 and window assembly 200 is sill liner 232 which is push fit onto base frame member 211 through the use of an attachment clip 233 which inserts into kerf 213. Sill liner 232 provides an additional aesthetic surface to the interior side of window assembly 200 and replaces the head, sill and side stops of window assembly 200.

From the foregoing disclosure, it should be appreciated that window assembly 100, 200 can be constructed from different types of materials whereby the advantages of each type of material is utilized to provide a high quality, yet economic window. In general terms, window assembly can be made from three types of materials. The first type is a wood type material which includes all varieties of wood and products created from wood products, for example hardwoods. The second type is a metal type material which includes all metals and materials having a metal content, for example aluminum and aluminum alloys. The third type of material is any material which does not fall within the first two material types and is characterized as a "non-wood/non-metal" material. This type would include vinyl, for example.

In more specific terms, window assembly 100, 200 can be constructed such that base frame assembly 110, 210 is formed from vinyl, which is structurally adequate, watertight and economical. Additionally, the exterior components, such as exterior cladding assembly 140, 240 and exterior sash assembly 125, can be constructed from durable painted aluminum which provides the appearance of an aluminum window from the exterior. The interior trim components, including interior sash assembly 122, can be constructed of wood such that the window, when viewed from the inside has the appearance of an all wood window. Thus, the foregoing disclosure allows for an assembled window to be constructed having a non-wood/non-metal vinyl structural frame, a metal aluminum exterior surface and a wood interior surface. Such a window assembly is not only economical, but also highly resistant to moisture and air infiltration and has good thermal insulation properties.

In addition to having lower material costs, the snap fit nature of the exterior cladding assembly 140; sash assembly 120; jamb extender assembly 130; and the push-fit nature of head, sill and side stop assemblies 150, 160, 170 further reduce manufacturing costs and production times. Further, the fact that exterior cladding assembly 140, base frame assembly 110 and exterior sash assembly can be formed form lineal stock having a uniform cross-section further reduces capital requirements and manufacturing costs.

With regard to the foregoing description, it is to be understood that changes may be made in detail, especially in matters of the construction materials employed and the shape, size and arrangement of the parts without departing from the scope of the present disclosure. It is intended that the specification and depicted aspects be considered exemplary only, with a true scope and spirit of the invention being indicated by the broad meaning of the following claims.

We claim:

1. A window assembly comprising:

(a) a base frame assembly including a plurality of base frame members that form a frame, the base frame assembly being attachable to an opening in a wall and being constructed of a plastic type material, each base frame member having a pair of extension clips;

(b) an external cladding assembly including a plurality of cladding members that form a frame, the external cladding assembly being connected to the base frame assembly by a snap-fit connection, the external cladding assembly being constructed of a metal type material;

(c) an interior trim assembly including a jamb extender assembly, a head stop, a sill stop, and two side stops extending between the head and sill stops, the interior trim assembly concealing at least a portion of the base frame assembly from view from an interior side, each component of the interior trim assembly being constructed of a wood type material and directly attached to the base frame assembly with a non-adhesive connection, wherein the jamb extender assembly is connected to the base frame assembly with the base frame member extension clips to form a snap-fit connection such that the extension clips extend beyond an interior face of the head and sill stops and at least beneath the two side stops; and (d) a sash assembly constructed and arranged to hold a window pane, the sash assembly being operably connected to the base frame assembly and having an exterior sash assembly constructed of a metal type material and an interior sash assembly constructed of a wood type material, the interior sash assembly being directly connected to the exterior sash assembly to form a wood-metal snap-fit connection;

(e) wherein the base frame members and the cladding members are each formed from a stock material having a uniform profile.

2. A window assembly according to claim 1, wherein the snap-fit connection between the base frame and cladding assemblies is achieved by clips having recesses provided on the base frame members and corresponding inward protrusions provided on the cladding members.

3. A window assembly according to claim 1, wherein the sash assembly is movable relative to the base frame assembly.

4. A window assembly according to claim 3, wherein the window assembly is a casement type window.

5. A window assembly according to claim 1, wherein the interior trim assembly includes a head stop assembly, a side stop assembly, a sill stop assembly and a jamb extension assembly, the head stop assembly being connected to one base frame member and defining a top of the window assembly, the sill stop assembly being connected to another base frame member and defining a bottom of the window assembly, the side stop assembly comprising two side stop members, each of which are connected to a base frame member and defining a first and second side of the window assembly.

6. A window assembly according to claim 5, wherein the jamb extension assembly is connected to the base frame assembly by a snap-fit connection.

7. A window assembly according to claim 6, wherein the snap fit connection is achieved by clips having inward protrusions provided on the base frame members and at least one corresponding recess provided on the jamb extension assembly.

8. A window assembly according to claim 5, wherein the head stop assembly, side stop assembly and sill stop assembly are connected to the base frame members by a push-fit connection.

9. A window assembly according to claim 8, wherein the push-fit connection is achieved through the use of attachment clips having extensions which extend into kerfs of the base frame members.

10. A window assembly according to claim 3, wherein the interior and exterior sash assembly are connected to each other to secure the window pane by a snap-fit connection.

11. A window assembly according to claim 10, wherein the snap-fit connection is achieved by clips provided on the exterior sash assembly and corresponding recesses provided on the interior sash assembly and wherein the clips have inward protrusions which snap-fit into the recesses.

12. A window assembly according to claim 10, the exterior sash assembly being comprised of:

(a) sash members having cut ends, the cut ends being adjacent to other cut ends of the sash members to form a frame;

(b) at least one corner key located at each cut end of the sash member; and (c) a sealant.

13. A window assembly according to claim 2, the exterior cladding assembly being comprised of:

(a) cladding members having cut ends, the cut ends being adjacent to other cut ends of the cladding members to form a frame;

(b) at least one corner key located at each cut end of the cladding member; and (c) a sealant.

14. A window assembly according to claim 1, wherein the base frame members are formed from a weldable material and wherein corners of the base frame members are joined to each other by a welded seam.

15. A window assembly according to claim 14, wherein the first and second materials are selected from the group consisting of aluminum, aluminum alloys, polyvinyl chloride, plastic composites, fiber composites, polyoleifins, polyurethanes and polyamides.

16. A window assembly comprising:

(a) a base frame assembly including a plurality of base frame members that form a frame, the base frame assembly being attachable to an opening in a wall and being constructed of a plastic type material, each base frame member having a pair of extension clips;

(b) an external cladding assembly including a plurality of cladding members that form a frame, the external cladding assembly being connected to the base frame assembly by a snap-fit connection with clips integral to the external cladding assembly that engage with recesses in the base frame assembly;

(c) an interior trim assembly including a jamb extender assembly, a head stop, a sill stop, and two side stops extending between the head and sill stops, the interior trim assembly concealing at least a portion of the base frame assembly from view from an interior side, each component of the interior trim assembly being constructed of a wood type material and directly attached to the base frame assembly with clips integral to the base frame assembly that engage with corresponding recesses in the interior trim assembly, wherein the jamb extender assembly is connected to the base frame assembly with the base frame member extension clips to form a snap-fit connection such that the extension clips extend beyond an interior face of the head and sill stops and at least beneath the two side stops; and (d) a sash assembly constructed and arranged to hold a window pane, the sash assembly being operably connected to the base frame assembly and having metal exterior sash assembly and an interior sash assembly, the interior sash assembly being constructed of a wood type material and being directly connected to the exterior sash assembly to form a wood-metal connection;

(e) wherein the base frame members and the cladding members are each formed from a stock material having a uniform profile.

* * * * *